US009768558B1

(12) United States Patent
Pickel et al.

(10) Patent No.: US 9,768,558 B1
(45) Date of Patent: Sep. 19, 2017

(54) ELECTRICAL CONNECTOR AND GROUND STRUCTURE CONFIGURED TO REDUCE ELECTRICAL RESONANCE

(71) Applicant: TYCO ELECTRONICS CORPORATION, Berwyn, PA (US)

(72) Inventors: Justin Dennis Pickel, Hummelstown, PA (US); Timothy Robert Minnick, Enola, PA (US); Chad William Morgan, Carneys Point, NJ (US); David Wayne Helster, Dauphin, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/189,630

(22) Filed: Jun. 22, 2016

(51) Int. Cl.
*H01R 13/6587* (2011.01)
*H01R 13/6471* (2011.01)
*H01R 13/6585* (2011.01)
*H01R 12/71* (2011.01)

(52) U.S. Cl.
CPC ..... *H01R 13/6471* (2013.01); *H01R 12/716* (2013.01); *H01R 13/6585* (2013.01)

(58) Field of Classification Search
CPC ..... H01R 13/6587; H01R 13/6586; H01R 23/688; H01R 13/514
USPC ..... 439/607.07, 607.06, 108, 92
See application file for complete search history.

(56) References Cited

U.S. PATENT DOCUMENTS 5,496,183 A * 3/1996 Soes ..... H01R 13/6471 439/607.23
5,851,121 A * 12/1998 Thenaisie ..... H01R 23/688 439/607.08
7,364,458 B1 * 4/2008 Ju ..... H01R 13/2414 439/524
8,636,543 B2 * 1/2014 McNamara ..... H01R 13/6461 439/607.07
2010/0144204 A1 * 6/2010 Knaub ..... H01R 13/514 439/607.07
2012/0094536 A1 * 4/2012 Khilchenko ..... H01R 12/724 439/620.21
2015/0372427 A1 * 12/2015 De Geest ..... H01R 13/6471 439/78

* cited by examiner

*Primary Examiner* — Gary Paumen

(57) ABSTRACT

Electrical connector includes a connector housing. The electrical connector also includes a plurality of signal conductors coupled to the connector housing. Each of the signal conductors has a first terminal, a second terminal, and an elongated conductor body extending between the first and second terminals. The first terminals are configured to engage corresponding conductive elements of an electrical component. The electrical connector also includes a ground structure coupled to the connector housing. The ground structure is positioned between adjacent signal conductors and has an exterior surface. At least a portion the exterior surface has a textured area that is configured to dampen reflected energy that propagates there along.

20 Claims, 7 Drawing Sheets

ELECTRICAL CONNECTOR AND GROUND STRUCTURE CONFIGURED TO REDUCE ELECTRICAL RESONANCE

BACKGROUND

The subject matter herein relates generally to electrical connectors that have signal conductors configured to convey data signals and ground structures that provide a ground return path, reduce crosstalk between the signal conductors, and/or control impedance.

Communication systems exist today that utilize electrical connectors to transmit data. For example, network systems, servers, data centers, and the like may use numerous electrical connectors to interconnect the various devices of the communication system. Many electrical connectors include signal conductors and ground structures that are positioned between the signal conductors. The ground structures provide return current paths, mitigate crosstalk between the signal conductors, and control impedance. Examples of such ground structures include elongated ground conductors and ground shields.

As one example, a known communication system includes receptacle connectors mounted to daughter cards that are configured to engage header connectors mounted to a backplane. The receptacle connector includes a plurality of contact modules that are stacked side-by-side. Each contact module includes signal conductors, ground conductors, and at least one ground shield. The signal conductors are arranged in signal pairs and the ground conductors are positioned between adjacent signal pairs. The signal and ground conductors may be arranged in a ground-signal-signal-ground (GSSG) pattern such that the signal and ground conductors are aligned in a common plane. The ground shield electrically shields the signal and ground conductors of one contact module from the signal and ground conductors of another conductor. The ground shield also provides a return path and controls impedance of the receptacle connector.

As another example, a known input/output (I/O) connector is configured to receive a pluggable small-form factor (SFF) module. The I/O connector includes a connector housing that forms a slot for receiving a circuit board from the pluggable SFF module. The I/O connector includes one or more rows of conductors in which each conductor engages a corresponding contact pad of the circuit board. The conductors include signal and ground conductors and may be arranged in a ground-signal-signal-ground (GSSG) pattern for each row.

There has been a general demand to increase the density of signal conductors within the electrical connectors and/or increase the speeds at which data is transmitted through the electrical connectors. As data rates increase and/or distances between the signal pairs decrease, however, it becomes more challenging to maintain a baseline level of signal quality. For example, the ground structures (e.g., the ground conductors and/or ground shields) may form fields that propagate between different points of the ground structures. The fields may then be repeatedly reflected and form a resonating condition (or standing wave) that causes electrical noise. Depending on the frequency of the data transmission, the electrical noise may increase return loss and/or crosstalk and reduce throughput of the electrical connector.

Although techniques for dampening electrical resonance exist, the effectiveness and/or cost of implementing these techniques is based on a number of variables, such as the geometries of the connector housing, the signal and ground conductors, and the ground shields. For some applications and/or electrical connector configurations, alternative methods for controlling resonance along the ground structures may be desired.

Accordingly, there is a need for electrical connectors that reduce the electrical noise caused by resonating conditions in ground structures.

BRIEF DESCRIPTION

In one embodiment, an electrical connector is provided that includes a connector housing. The electrical connector also includes a plurality of signal conductors coupled to the connector housing. Each of the signal conductors has a first terminal, a second terminal, and an elongated conductor body extending between the first and second terminals. The first terminals are configured to engage corresponding conductive elements of an electrical component. The electrical connector also includes a ground structure coupled to the connector housing. The ground structure is positioned between adjacent signal conductors and has an exterior surface. At least a portion the exterior surface has a textured area that is configured to dampen reflected energy that propagates there along.

The electrical component may be, for example, another electrical connector or a circuit board. In some embodiments, the electrical connector may be positioned between and interconnect two other electrical connectors. The conductive elements may be other electrical contacts or plated thru-holes (PTHs).

Optionally, the signals conductors may be arranged in signal pairs. Each of the signal pairs includes two of the signal conductors extending essentially parallel to each other for differential signaling. The ground structure may be positioned between adjacent signal pairs.

In some aspects, the ground structure may include a ground shield having a panel section that extends between the adjacent signal conductors and a coupling finger that directly engages another component of the electrical connector. Optionally, the exterior surface includes opposite side surfaces of the ground structure. The ground structure may have a stamped edge that extends between the side surfaces. At least one of the side surfaces may have the textured area. In particular embodiments, at least 65% of a total area of the at least one side surface is textured. Optionally, the textured area is one textured area of a plurality of textured areas. The at least one side surface may include the plurality of the textured areas in which the textured areas are separated from one another by one or more smooth areas.

In some aspects, the exterior surface along the panel section includes at least a portion of the textured area and the exterior surface along the coupling finger either (1) has a smooth area or (2) has a degree of texture that is less than a degree of texture along the panel section.

In some aspects, the ground structure includes an elongated ground conductor that extends essentially parallel to the adjacent signal conductors. The ground conductor may have the exterior surface. Optionally, the ground conductor has a mating zone that is configured to engage a corresponding contact of another electrical component. The exterior surface along the mating zone may have a smooth area. Optionally, the ground conductor is a plurality of ground conductors, and the signal and ground conductors form a ground-signal-signal-ground (GS SG) pattern.

In some aspects, the ground structure has a plating layer. The plating layer includes a ferromagnetic material that increases a dampening effect of the textured area.

In some aspects, the ground structure includes an intervening layer and a plating layer that is plated over the intervening layer. The plating layer may include the textured area, and the intervening layer may have a textured surface that causes the textured area along the plating layer.

In some aspects, the exterior surface includes a smooth area. The textured area has at least one of (a) an average surface roughness that is at least two-and-a-half times (2.5×) an average surface roughness of the smooth area; (b) a root mean square roughness that is at least two-and-a-half times (2.5×) the root mean square roughness of the smooth area; or (c) a developed surface area ratio with respect to the smooth area that is at least 2.5:1.

In some aspects, the textured area has at least one of an average surface roughness of at least 1.0 μm or a root mean square roughness that is at least 1.0 μm.

In an embodiment, an electrical connector is provided that includes a connector shroud having a mating side and a loading side. The mating side is configured to engage another connector during a mating operation. The connector shroud has passages extending between the mating and loading sides. The electrical connector also includes a plurality of contact modules having front edges configured to engage the loading side of the connector shroud. Each of the contact modules includes a plurality of signal conductors each having a mating terminal, a mounting terminal, and an elongated conductor body extending between the mating and mounting terminals. The mating terminals are positioned along the front edge of the respective contact module. The signal conductors are arranged in signal pairs that are aligned in a conductor plane. The electrical connector may also include a ground shield having a panel section that extends parallel to the conductor plane and is positioned between the signal conductors of the respective contact module and the signal conductors of an adjacent contact module. At least a portion of the panel section has an exterior surface that includes a textured area configured to dampen reflected energy that propagates there along.

In some aspects, the exterior surface includes opposite side surfaces along the ground shield. At least one of the side surfaces has the textured area, wherein at least 65% of a total area of the at least one side surface is textured. Optionally, the textured area has at least one of an average surface roughness of at least 1.0 μm or a root mean square roughness that is at least 1.0 μm.

In an embodiment, an electrical connector is provided that includes a connector housing having a mating side configured to mate with a mating connector and a mounting side configured to be mounted to a circuit board. The electrical connector also includes signal and ground conductors extending through the connector housing. The signal and ground conductors are configured to engage the mating connector and be terminated to the circuit board. The signal conductors form a plurality of signal pairs configured to carry differential signals. The ground conductors are interleaved between the signal pairs to form a ground-signal-signal-ground (GSSG) pattern. The ground conductors have respective exterior surfaces. At least a portion of each of the exterior surfaces has a respective textured area that is configured to dampen reflected energy that propagates there along.

In some aspects, the ground conductors have mating zones that are configured to engage corresponding contacts of the other connector. The exterior surface along each of the mating zones has a smooth area. Optionally, the textured area has at least one of an average surface roughness of at least 1.0 μm or a root mean square roughness that is at least 1.0 μm.

DETAILED DESCRIPTION

Figure 1:
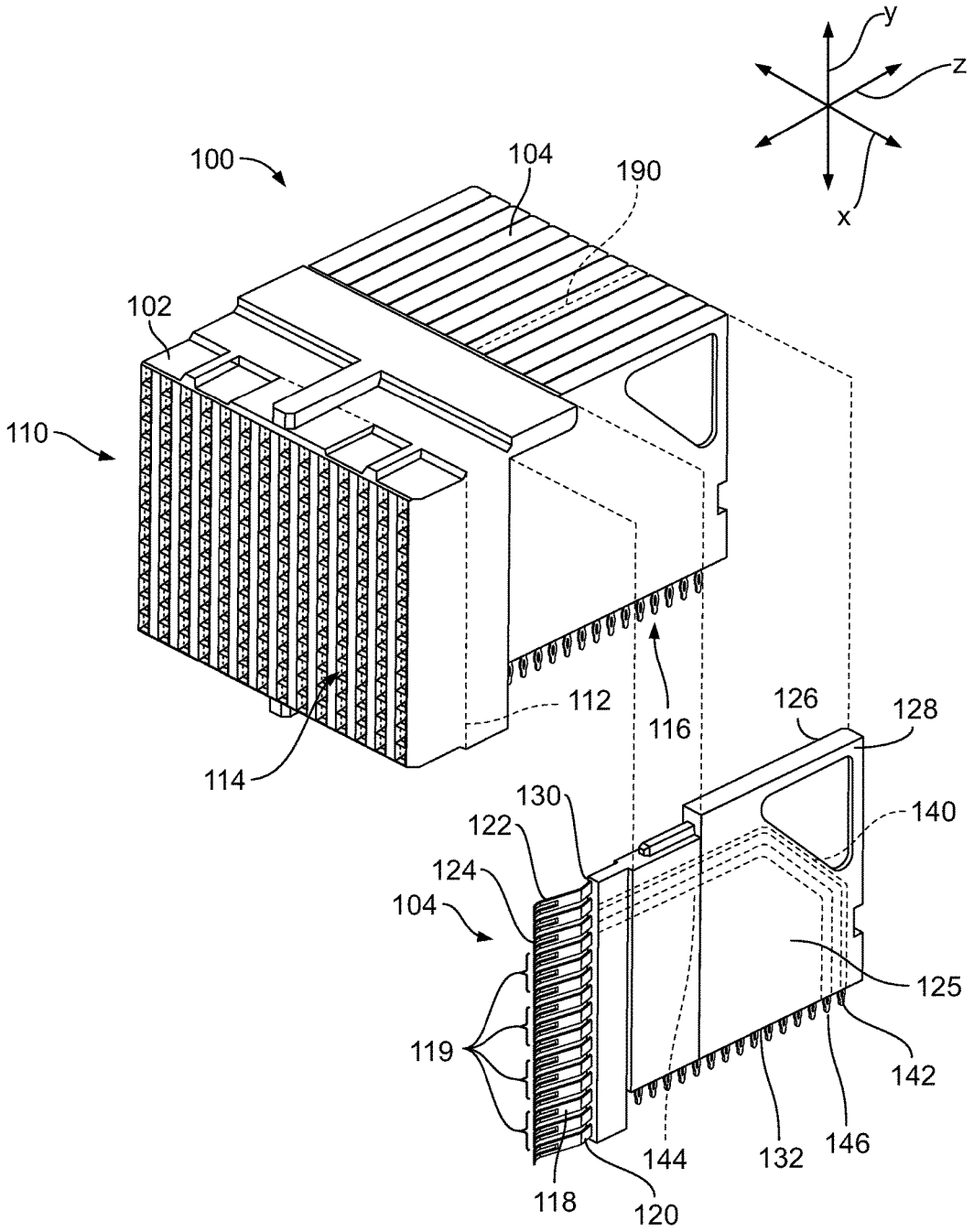
FIG. 1 is a front perspective view of an electrical connector formed in accordance with an embodiment.

Embodiments set forth herein include electrical connectors having signal conductors configured to convey data signals and ground structures that provide a ground return path, reduce crosstalk between the signal conductors, and/or control impedance. The ground structures may include, for example, ground shields that are positioned between adjacent signal conductors and/or elongated ground conductors that are positioned between adjacent signal conductors. Embodiments may be configured to improve electrical performance by, for example, dampening or impeding electrical resonance that may occur along the ground structures.

In some embodiments, the electrical connectors are configured to mate with other electrical connectors during a mating operation. During the mating operation, a first conductor of one connector may engage and slide (or wipe) along a second conductor of the other connector. The first and second conductors may engage each other at mating zones. The mating zones typically have smooth surfaces to create a sufficient number of contact points between the first and second conductors. The first and second conductors may be signal conductors or ground conductors.

Although the illustrated embodiment includes electrical connectors that are used in high-speed communication systems, such as backplane or midplane communication systems or input/output (I/O) systems, it should be understood that embodiments may be used in other communication systems or in other systems/devices that utilize ground structures. Accordingly, the inventive subject matter is not limited to the illustrated embodiments.

For example, the electrical connectors shown in the drawings have a mating side that is configured to mate with another connector and a mounting side that is configured to be mounted to a printed circuit board. It should be understood, however, that electrical connectors set forth herein may be configured to interconnect a different combination of electrical components (e.g., other electrical connectors, circuit boards, or other components having conductive pathways). For instance, in some embodiments, the electrical connector may have a first side that is configured to mate with a first electrical connector and a second side that is configured to mate with a second electrical connector. Alternatively, the first side may be configured to be mounted to a first circuit board and the second side may be configured to be mounted to a second circuit board.

To impede or reduce the unwanted effects of electrical resonance, embodiments described herein include a ground structure having an exterior surface in which at least a portion of the exterior surface is textured. In this context, texture refers to a quality of the surface of the ground structure. For example, a surface may have varying degrees of smoothness, roughness, or waviness. As used herein, an area-of-interest of a surface is "more textured" than another area if the area-of-interest is rougher and/or wavier than the other area. A textured area is more textured than a smooth area if the textured area is at least two times (2×) rougher or wavier than the smooth area based on a surface parameter. Surface parameters that may be used to determine whether one area is more textured than another area include an average surface roughness, a root-mean-square average roughness, or a developed surface area ratio. As used herein, the phrase "is textured" means that the surface has been processed in some manner to be more textured than the surface prior to the process.

Ground structures described herein may include a plurality of different materials. For example, a ground structure may include a base material, such as copper or copper alloy (e.g., beryllium copper), phosphor bronze, or brass, that is plated or coated with one or more other materials. As used herein, when another material is "plated over" or "coated over" a base material, the other material may directly contact or bond to an outer surface of the base material or may directly contact or bond to an outer surface of an intervening material. More specifically, the other material is not required to be directly adjacent to the base material and may be separated by an intervening layer.

Different materials of a ground structure may be selected to impede electrical resonance. For example, one or more of the materials used in the ground structures may be ferromagnetic. More specifically, one or more materials may have a higher relative magnetic permeability. In particular embodiments, the ground structure includes a material that has a permeability that is, for example, greater than 50. In some embodiments, the permeability is greater than 75 or, more specifically, greater than 100. In certain embodiments, the permeability is greater than 150 or, more specifically, greater than 200. In particular embodiments, the permeability is greater than 250, greater than 350, greater than 450, greater than 550, or more. Non-limiting examples of such materials include nickel, carbon steel, ferrite (nickel zinc or manganese zinc), cobalt, martensitic stainless steel, ferritic stainless steel, iron, or alloys of the same. In some embodiments, the material is a martensitic stainless steel (annealed). Materials that have a higher permeability provide a higher internal self-inductance. High permeability may also cause shallow skin depths, which may increase the effective resistance of the ground structure within a predetermined frequency band.

Embodiments may be particularly suitable for communication systems, such as network systems, servers, data centers, and the like, in which the data rates may be greater than ten (10) gigabits/second (Gbps) or greater than five (5) gigahertz (GHz). One or more embodiments may be configured to transmit data at a rate of at least 20 Gbps, at least 40 Gbps, at least 56 Gbps, or more. One or more embodiments may be configured to transmit data at a frequency of at least 10 GHz, at least 20 GHz, at least 28 GHz, or more. As used herein with respect to data transfer, the term "configured to" does not mean mere capability in a hypothetical or theoretical sense, but means that the embodiment is designed to transmit data at the designated rate or frequency for an extended period of time (e.g., expected time periods for commercial use) and at a signal quality that is sufficient for its intended commercial use. It is contemplated, however, that other embodiments may be configured to operate at data rates that are less than 10 Gbps or operate at frequencies that are less than 5 GHz.

Various embodiments may be configured for certain applications. One or more embodiments may be configured for backplane or midplane communication systems. For example, one or more of the electrical connectors described herein may be similar to electrical connectors of the Z-PACK TinMan product lines developed by TE Connectivity. The electrical connectors may include high-density arrays of signal conductors. A high-density array may have, for example, at least 12 signal contacts per 100 $mm^2$ along a first side or a second side of the electrical connector. In more particular embodiments, the high-density array may have at least 20 signal contacts per 100 $mm^2$.

Non-limiting examples of some applications that may use embodiments set forth herein include host bus adapters (HBAs), redundant arrays of inexpensive disks (RAIDs), workstations, servers, storage racks, high performance computers, or switches. Embodiments may also include electrical connectors that are small-form factor connectors. For example, the electrical connectors may be configured to be compliant with certain standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard.

As used herein, phrases such as "a plurality of [elements]" and "an array of [elements]" and the like, when used in the detailed description and claims, do not necessarily include each and every element that a component may have. The component may have other elements that are similar to the plurality of elements. For example, the phrase "a plurality of ground structures [being/having a recited feature]" does not necessarily mean that each and every ground structure of the component has the recited feature. Other ground structures may not include the recited feature. Accordingly, unless explicitly stated otherwise (e.g., "each and every ground structure of the electrical connector [being/having a recited feature]"), embodiments may include similar elements that do not have the recited features.

FIG. 1 is a perspective view of a partially assembled electrical connector 100 formed in accordance with an embodiment. In some embodiments, the electrical connector 100 is a receptacle connector of a backplane communication system (not shown) that is configured to engage a header connector (not shown) during a mating operation. For example, the electrical connector 100 may be similar to electrical connectors of the Z-PACK TinMan product lines developed by TE Connectivity. The electrical connector 100 includes a connector housing 102 and a plurality of contact modules 104 that are coupled to the connector housing 102. An isolated view of one contact module 104 is shown. For reference, the electrical connector 100 is oriented with respect to mutually perpendicular X, Y, and Z axes.

The connector housing 102 includes a mating side (or face) 110 and a loading side 112, which is indicated by a dashed line along the connector housing 102. The mating side 110 may also be referred to as a first side for some embodiments. The connector housing 102 forms a shroud that engages front edges 130 of the contact modules 104. As such, the connector housing 102 may also be referred to as a connector shroud. The mating side 110 defines the front or forward-most portion of the electrical connector 100. The connector housing 102 has passages 114 that extend between the mating and loading sides 110, 112. The passages 114 align with first terminals 122, 124 of the contact modules 104 when the electrical connector 100 is fully assembled. The passages 114 are configured to receive signal pins (not shown) and ground shields (not shown) of the header connector that engage the first terminals 122 and first terminals 124, respectively. The first terminals 122 may also be referred to as mating terminals for some embodiments.

The contact modules 104 are stacked side-by-side. Each of the contact modules 104 includes a module body 125 having opposite sides 126, 128. The module body 125 is configured to hold a plurality of signal conductors 118 and a plurality of ground conductors 120. As such, the signal and ground conductors 118, 120 are indirectly coupled to the connector housing 102. In other embodiments, the connector housing 102 may directly engage and couple to the signal and ground conductors 118, 120.

The ground conductors 120 are positioned between adjacent signal conductors 118. For example, the signal conductors 118 are arranged in signal pairs 119. Adjacent signal pairs 119 have a corresponding ground conductor 120 extending therebetween. In the illustrated embodiment, all of the signal and ground conductors 118, 120 are aligned in a conductor plane 190 that extends parallel to a YZ plane. Optionally, the signal and ground conductors 118, 120 are overmolded with a material that forms the module body 125. For example, the signal and ground conductors 118, 120 may be formed from a common lead frame and the module body 125 may be overmolded around the lead frame.

The signal conductors 118 include the first terminals 122, and the ground conductors include the first terminals 124. The signal conductors 118 also include elongated conductor bodies 140 and second terminals 142. The second terminals 142 may also be referred to as mounting terminals for some embodiments. The elongated conductor bodies 140 extend between the first and second terminals 122, 142. The ground conductors 120 also include elongated conductor bodies 144 and second terminals 146. The elongated conductor bodies 144 extend between the first and second terminals 124, 146. In the illustrated embodiment, the second terminals 142, 146 are compliant pins configured to mechanically and electrically engage plated thru-holes (not shown) of a circuit board (not shown). For example, the second terminals 142, 146 may be eye-of-needle pins.

Each of the module bodies 125 also includes a mounting edge 132. The contact modules 104 collectively form a mounting side 116 of the electrical connector 100 that includes the mounting edges 132 and the second terminals 142, 146. The mounting edge 132 may be referred to as a module edge and the mounting side 116 may be referred to as a second side for some embodiments. Although not shown, each of the module bodies 125 may have a ground shield coupled to the body side 126 and/or the body side 128. The ground shield may be similar to the ground shield 202 (shown in FIG. 2).

Figure 2:
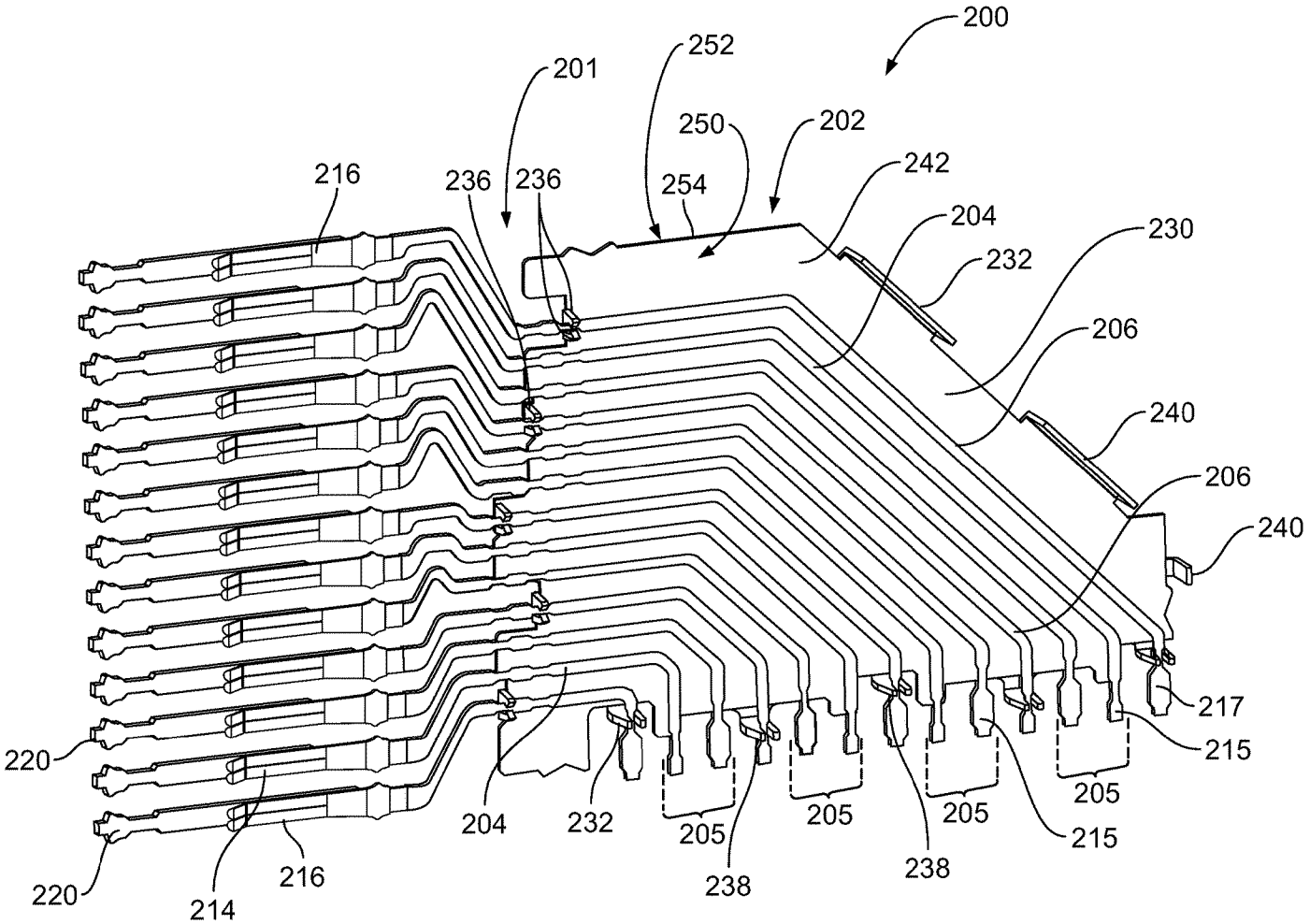
FIG. 2 is a perspective view of a sub-assembly that may be used with an electrical connector in accordance with an embodiment.

FIG. 2 is a perspective view of a sub-assembly 200 in accordance with an embodiment. The sub-assembly 200 may be used with, for example, the electrical connector 100 (FIG. 1). The sub-assembly 200 includes a ground structure 201. The ground structure 201 may be one or more components that provide a ground return path or paths, reduce crosstalk between the signal conductors, and/or control impedance of the electrical connector. In some embodiments, the ground structure 201 may be a single component. In other embodiments, the ground structure 201 may be multiple components that form a ground assembly. For example, the ground structure 201 includes a ground shield 202 and a plurality of ground conductors 206. The ground conductors 206 are electrically commoned by the ground shield 202.

In addition to the ground structure 201, the sub-assembly 200 also includes a plurality of signal conductors 204. Although not shown, a module body, such as the module body 125 (not shown), may encase portions of the signal and ground conductors 204, 206 to hold the signal and ground conductors 204, 206 in fixed positions with respect to one another. The ground shield 202 may be secured to a side (not shown) of a module body to form a contact module, such as the contact modules 104 (FIG. 1). At least some of the ground shields 202 are positioned between the signal and ground conductors of one contact module and the signal and ground conductors of an adjacent contact module. For example, the ground shield 202 separates the four signal pairs 205 and the corresponding ground conductors 206 from the signal pairs (not shown) and the corresponding ground conductors (not shown) of the adjacent contact module.

As shown, the signal conductors 204 are arranged in the signal pairs 205. Adjacent signal pairs 205 have a ground conductor 206 extending therebetween such that the signal and ground conductors 204, 206 form a GSSG pattern in which the ground conductors 206 are interleaved between the signal pairs 205. Each ground conductor 206 extends essentially parallel to the signal conductors 204 that the ground conductor 206 is positioned between. As used herein, the term "essentially parallel," when used in the context of conductors, allows for some jogging of the conductors and tolerances in the manufacturing process. Moreover, the signal and ground conductors 204, 206 are aligned in a conductor plane (not indicated) such as the conductor plane 190 (FIG. 1).

As shown in FIG. 2, the signal and ground conductors 204, 206 include first terminals 214, 216, respectively, that engage corresponding contacts 220 of another connector (not shown). The first terminals 214, 216 may engage the corresponding contacts 220 through a wiping action during a mating operation. In the illustrated embodiment, the first terminals 214, 216 include contact fingers or springs. The signal and ground conductors 204, 206 also include second terminals 215, 217, respectively. The second terminals 215, 217 may form compliant pins that are configured to engage plated thru-holes (not shown) of a circuit board (not shown). Only a portion of the second terminals 217 are shown in FIG. 2.

The ground shield 202 includes a panel section 230 and a plurality of coupling elements 232. The coupling elements 232 are structural features of the ground shield 202 that are shaped to engage other components of the electrical connector (not shown). The coupling elements 232 are projections of the ground shield 202 that extend away from the panel section 230. The coupling elements 232 may be oriented perpendicular to the panel section 230. The panel section 230 is configured to extend parallel to the conductor plane (not indicated). In the illustrated embodiment, each of the coupling elements 232 includes a portion of an outer shield edge 254 of the ground shield 202. The ground shield 202 may be stamped from sheet material (e.g., metal) and portions may be bent to form the coupling elements 232.

In the illustrated embodiment, the coupling elements 232 include coupling fingers 236, 238 and coupling tabs 240. The coupling fingers 236, 238 are configured to engage corresponding ground conductors 206 to electrically common the ground conductors 206. In FIG. 2, two coupling fingers 236 face each other and grip opposite edges of a single ground conductor 206. Likewise, two coupling fingers 238 face each other and grip opposite edges of a single ground conductor 206. In other embodiments, however, only one coupling finger 236 may engage the ground conductor 206 and/or only one coupling finger 238 may engage the ground conductor 206. For example, the coupling fingers 236, 238 may be contact beams that are deflected and exert a beam deflection force against the corresponding ground conductor 206. As shown, each of the ground conductors 206 engages coupling fingers 236 proximate to the first terminal 216 and coupling fingers 238 proximate to a second terminal 217. Unlike other portions of the ground shield 202, the coupling fingers 236, 238 may have surfaces with smooth areas that directly engage the ground conductor 206.

The coupling tabs 240 may form an interference fit with, for example, a corresponding module body (not shown), such as the module body 125 (FIG. 1). Accordingly, the coupling fingers 236, 238 may electrically common the ground conductors 206 and the coupling tabs 240 may secure the ground shield 202 and the ground conductors 206 to the module body.

In the illustrated embodiment, the ground shield 202 is stamped and formed from sheet material 242 such that the panel section 230 and the coupling elements 232 are formed from a single part. In other embodiments, the panel section 230 and one or more of the coupling elements 232 may be discrete elements that are attached to one another to form the ground shield 202. The ground shield 202 has opposite side surfaces 250, 252 and the ground edge 254 that extends between the side surfaces 250, 252. The ground edge 254 may be a stamped edge.

During operation, electrical energy guided by the ground structure 201 (e.g., the ground conductors 206 and the ground shield 202) may form one or more fields that propagate between the first and second terminals 216, 217. The fields may be repeatedly reflected and form a resonating condition (or standing wave) that causes a significant amount of electrical noise. Embodiments set forth herein include textured areas that are configured to dampen the electrical resonance.

Figure 3:
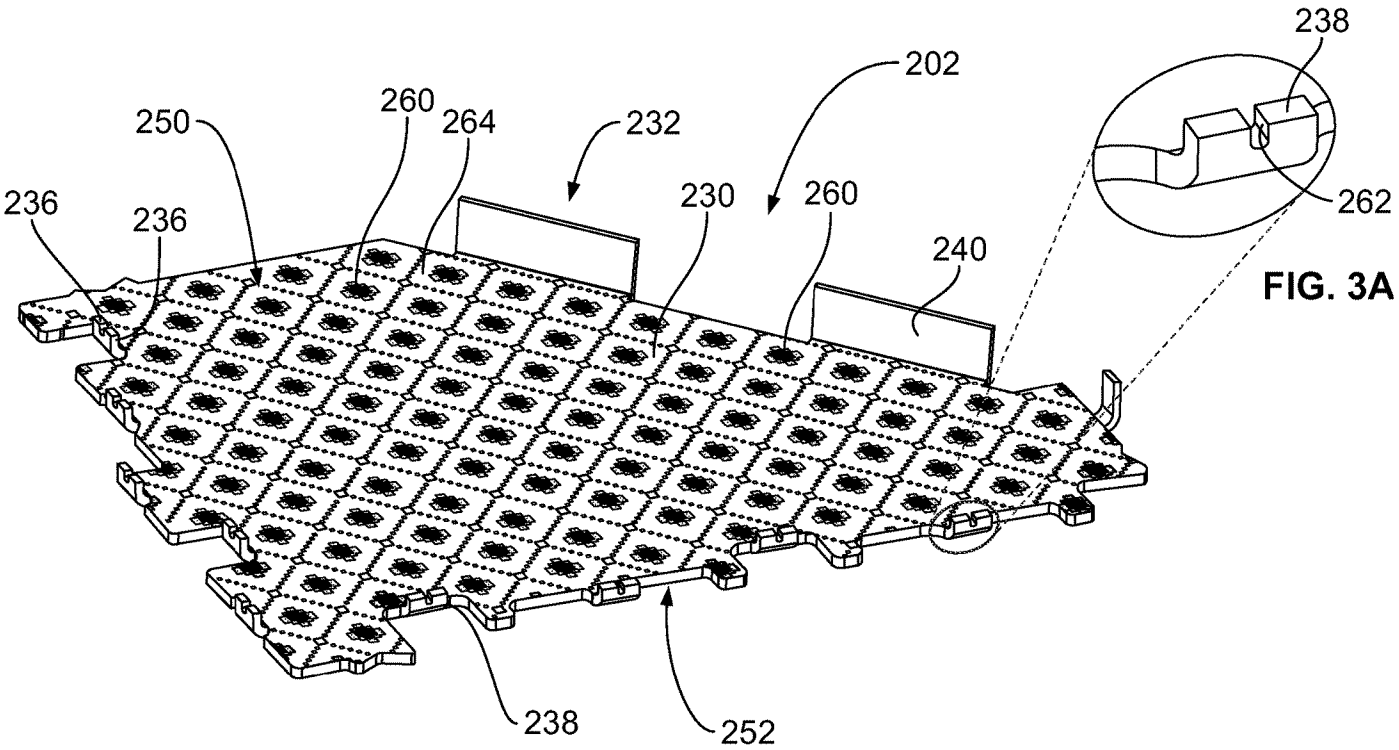
FIG. 3 is an isolated perspective view of a ground shield that may be used with the sub-assembly of FIG. 2.

FIG. 3 is an isolated perspective view of the ground shield 202. To reduce the unwanted effects of the resonating energy, embodiments may include one or more textured areas 260 along at least one of the side surfaces 250, 252 and/or one or more textured areas (not shown) along the ground conductors 206 (FIG. 2), such as the textured area 566 (shown in FIG. 7).

The side surfaces 250, 252 of the ground shield 202 are exterior surfaces of the ground shield 202. In particular embodiments, each of the side surfaces 250, 252 includes one or more textured areas 260. Textured areas have uneven (e.g., roughened or wavy) topographies compared to smooth areas 262. In the illustrated embodiment, the coupling fingers 236, 238 include corresponding smooth areas 262. The smooth areas 262 have relatively even topographies in order to create a sufficient number of points of contact between the ground shield 202 and the ground conductors 206. The smooth areas 262 of the two coupling fingers 236 face each other, and the smooth areas 262 of the two coupling fingers 238 face each other. Optionally, the coupling tabs 240 may include smooth areas.

The side surface 250 is shown in FIG. 3. Although the following description is with reference to the side surface 250, the description may also be applied to the side surface 252. The side surface 250 includes a pattern of textured areas 260 that are separated by smooth areas 264. In FIG. 3, the textured areas are shaded and the smooth areas are not shaded. The pattern may be configured to achieve a desired electrical performance. In other embodiments, however, the textured areas 260 may form a single textured area 260 that extends continuously along the ground shield 202 such that an entirety of the side surface 250 is textured. In particular embodiments, an entirety of the side surface 250 along the panel section 230 may be textured. The coupling elements 232 may or may not include textured areas.

Textured areas may have surface irregularities including peaks and troughs at a greater density and/or a greater height difference (peak-to-trough) compared to smooth areas. Without being held to a particular theory, it is believed that that the peaks and troughs of the textured area generate a greater amount of loss as the current propagates there along. It is also suspected that as current propagates down into a trough, it may induce current at a nearby peak. This self-inductance may generate more loss compared to smoother surfaces. In some cases, the randomness of the peaks and troughs may enhance the dampening effect. One or more of the effects described above may be particularly applicable for high speed applications because, at higher frequencies (e.g., greater than 10 GHz), current propagates proximate to or along the contact surface of the ground conductor.

Embodiments include one or more areas of the exterior surface that are more textured (e.g., rougher or wavier) than smooth areas of the exterior surface or other conventional ground structures. Whether an area of the exterior surface is a textured area may be determined by surface texture parameters, such as roughness parameters, that represent the number and extent of deviations along a surface. Textured areas may include irregular topographical deviations (e.g., caused by grinding, milling, or abrasive blasting the contact surface) or repeating topographical deviations (e.g., caused by stamping the ground conductor).

Textured areas may be manufactured through one or more processes. For example, areas of the ground structures may be roughened by subtractive methods, additive methods, or other methods. Subtractive methods for providing textured areas may include mechanical, chemical, and/or thermal techniques. During a subtractive process, material from a blank (e.g., sheet of material) or a partially formed ground conductor (e.g., workpiece) may have material removed from the blank or contact body. Non-limiting examples of subtractive processes that may roughen or render the surface more wavy include sawing, shaping, stamping, drilling, milling, boring, grinding, abrasive (e.g., sand or bead) blasting, chemical milling, abrasive water-jet machining (AWJM), abrasive jet machining (AJM), abrasive grinding, electrolytic in-process dressing (ELID) grinding, casting, hot rolling, forging, electrical discharge machining (EDM), etching (e.g., physical/chemical etching, vapor phase etching, electrochemical etching (ECM), reactive-ion etching (RIE)), chemical machining (CM), electrochemical grinding (ECG), laser machining, or electron beam machining. The above list is not intended to be limiting and other subtractive techniques or processes may be used.

It is also contemplated that the textured areas may be provided by additive techniques in which material is added to the ground structure. Such processes include electroplating, physical vapor deposition (PVD), evaporation (e.g., thermal evaporation), sputtering, ion plating, ion cluster beam deposition, pulsed laser deposition, chemical vapor deposition (CVD), atomic layer deposition (ALD), thermal spray deposition, diffusion, laser sputter deposition, casting, ink jet printing, electrochemical forming processes, electrodeposition, laser beam deposition, electron beam deposition, plasma spray deposition, and the like. The above list is not intended to be limiting and other additive techniques or processes may be used.

It is also contemplated that the textured areas may be provided without adding or subtracting material, such as in shaping the material. For example, a mold may be provided that is stamped into a blank that forms the ground structure. The mold may include an exterior surface that is shaped to provide the textured area along the exterior surface.

One parameter that may be used to determine whether the textured area is more textured than a smooth area or to determine a roughness value is average surface roughness ($R_a$), which is defined in International Organization for Standards (or ISO) 25178-2 (2012) and the American Society of Mechanical Engineers (or ASME) B46.1-2009. Although the term includes roughness, waviness may also be calculated using the average surface roughness formula. Average surface roughness is an arithmetic average of the absolute values of the profile height deviations from a mean line (or plane) for a designated length (or area). In some embodiments, the textured area may have an average surface roughness that is at least two times (2×) greater than the average surface roughness of a smooth area. In some embodiments, the textured area may have an average surface roughness of at least 1.0 μm, at least 1.5 μm, at least 2.0 μm, at least 2.5 μm, at least 3 μm, or more. In certain embodiments, the textured area may have an average surface roughness of at least 5 μm, at least 10 μm, at least 15 μm, at least 20 μm, at least 30 μm, or more. The average surface roughness of the smooth area may be less than 1.0 μm. In particular embodiments, the average surface roughness of the smooth area may be less than 0.7 μm, less than 0.5 μm, or less than 0.3 μm.

Another parameter that may be used to determine whether a textured area is more textured than another area or to determine a roughness value is a root mean square ($R_q$) roughness, which is defined as the root mean square (RMS) average of profile height deviations taken within an evaluation length (or area) and measured from a mean line (or plane). Root mean square (RMS) roughness is defined in ISO 25178-2 (2012) and ASME B46.1-2009. In some embodiments, the textured area may have an RMS roughness of at least 1.0 μm, at least 1.5 μm, at least 2.0 μm, at least 2.5 μm, at least 3 μm, or more. In certain embodiments, the textured area may have an RMS roughness of at least 5 μm, at least 10 μm, at least 15 μm, at least 20 μm, at least 30 μm, or more. The RMS roughness of the smooth area may be less than 1.0 μm. In particular embodiments, the RMS roughness of the smooth area may be less than 0.7 μm, less than 0.5 μm, or less than 0.3 μm.

Yet another parameter that may be used to determine whether a textured area is more textured than another area or to determine a roughness value is the developed surface area ratio ($S_{dr}$), which is expressed as the percentage or factor of additional surface area contributed by the texture as compared to an area of an ideal plane along the measurement length or area. The developed surface area ratio is defined in ISO 25178-2 (2012). In some embodiments, the textured area may have a developed surface area ratio that is at least two times (2×) greater than the developed surface area ratio of a smooth area. For instance, the developed surface area ratio may be at least 2.5:1 or at least 3:1. In some embodiments, the developed surface area ratio may be at least 5:1, at least 8:1, at least 10:1, at least 15:1, at least 20:1, or a greater ratio. The developed surface area ratio of the smooth area may be less than 2:1. In particular embodiments, the developed surface area ratio of the smooth area may be less than 2.0:1 or less than 1.5:1.

Each of the above parameters (average surface roughness, RMS roughness, or developed surface area ratio) may be determined using, for example, a stylus profilometer or an optical profilometer. Each of the ISO 25178-2 (2012) and ASME B46.1-2009 is incorporated herein by reference in its entirety for calculating and measuring average surface roughness, RMS roughness, and developed surface area ratio. As one example, the optical profilometer may be configured to perform Coherence Scanning Interferometry (CSI) or white light interferometry to determine the above parameters.

In some embodiments, the textured area has at least one of (a) an average surface roughness that is at least two-and-a-half times (2.5×) an average surface roughness of a smooth area; (b) an RMS roughness that is at least two-and-a-half times (2.5×) the RMS roughness of a smooth area; or (c) a developed surface area ratio with respect to a smooth area that is at least 2.5:1. To determine the above parameters, the textured area and a smooth area should be analyzed using the same method(s). The method(s) should be accepted by manufacturers of ground conductors (or related structures) for determining the above parameters. Such methods may be, for example, those methods used when designing machinery or during quality control. Such methods may be described in organizational standards, such as ISO 25178-2 (2012) and ASME B46.1-2009 and related sections. In some cases, the textured area and a smooth area may be analyzed using an optical profilometer that is configured to perform CSI or white light interferometry.

In certain embodiments, the textured area has at least one of (a) an average surface roughness that is at least three times (3×) an average surface roughness of a smooth area; (b) an RMS roughness that is at least three times (3×) the RMS roughness of a smooth area; or (c) a developed surface area ratio with respect to a smooth area that is at least 3:1. In more particular embodiments, the textured area has at least one of (a) an average surface roughness that is at least five times (5×) an average surface roughness of a smooth area; (b) an RMS roughness that is at least five times (5×) the RMS roughness of a smooth area; or (c) a developed surface area ratio with respect to a smooth area that is at least 5:1. Other factors or values may be used. For example, the multiplier for average surface roughness may be 7×, 10×, 15×, 20×, or more. The multiplier for RMS roughness may be 7×, 10×, 15×, 20×, or more. The ratio for developed surface area ratio may be 7:1, 10:1, 15:1, 20:1, or more.

In some embodiments, only one or two of the above parameters may be used to confirm whether an area is sufficiently textured. For example, only the average surface roughness may be used. In some cases, when two parameters are used, the textured area is sufficient if either parameter is satisfied. In other cases, the textured area may only be sufficiently textured if two of the three parameters or all three parameters are satisfied. For example, in some embodiments, the textured area is sufficiently textured only when the average surface roughness is above a designated value, the RMS roughness is above a designated value, and the developed surface area ratio is above a designated ratio. Any combination of the above parameters may be used.

Although the above examples for different parameters include multipliers or ratios with similar or identical values, different values may be used in other embodiments. For example, the textured area may have at least one of an average surface roughness that is at least three times (3×) an average surface roughness of a smooth area and an RMS roughness that is at least four times (4×) the root mean square roughness of a smooth area.

In some embodiments, at least 30% of a total area of the side surface 250 and/or at least 30% of a total area of the side surface 252 is textured. In some embodiments, at least 50% of a total area of the side surface 250 and/or at least 50% of a total area of the side surface 252 is textured. In more particular embodiments, at least 65% of a total area of the side surface 250 and/or at least 65% of a total area of the side surface 252 is textured. In more particular embodiments, at least 80% of a total area of the side surface 250 and/or at least 80% of a total area of the side surface 252 is textured. In more particular embodiments, at least 90% of a total area of the side surface 250 and/or at least 90% of a total area of the side surface 252 is textured. In more particular embodiments, an entirety of the side surface 250 and/or an entirety of the side surface 252 is textured. Optionally, the ground edge 254 may be textured.

Although the above numbers appear to indicate that the side surfaces will have an equal amount of textured areas, it should be understood that side surfaces 250, 252 may have different sizes of textured areas and/or different patterns or positions of textured areas. For example, 50% of the side surface 250 may be textured, but 65% of the side surface 252 may be textured. Moreover, although the above numbers refer to the total area of the side surface 250 or the side surface 252, the same numbers may be applied to the side surface 250 along only the panel section 230. For example, at least 30% of a total area of the side surface 250 along the panel section 230 may be textured.

Alternatively or in addition to the ground shield 202 including textured areas, the ground conductors 206 may include textured areas. Ground conductors having textured areas are described in greater detail below.

Figure 4:
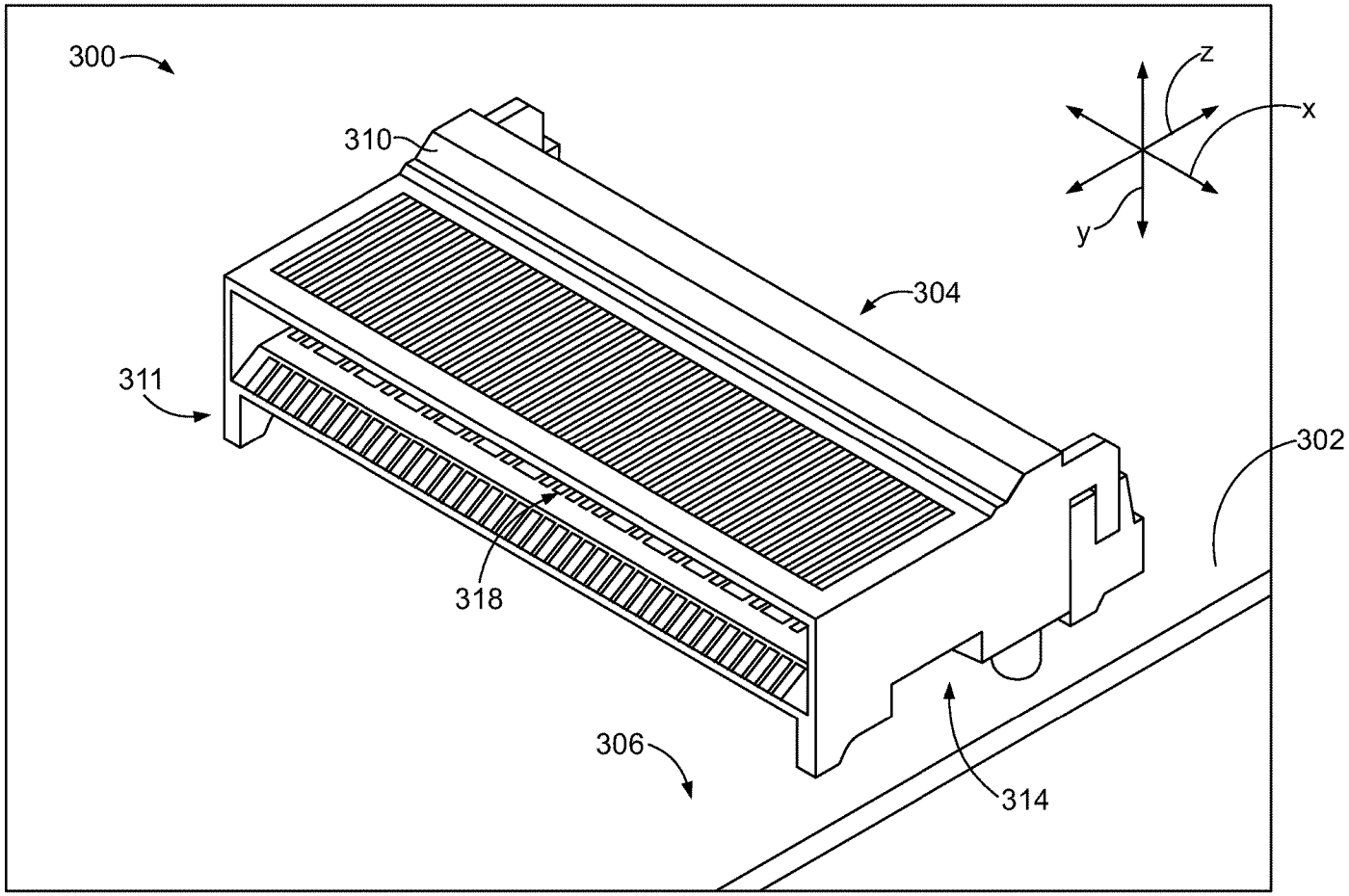
FIG. 4 is a circuit board assembly having an electrical connector formed in accordance with an embodiment.

FIG. 4 is a perspective view of a portion of a circuit board assembly 300 formed in accordance with an embodiment. The circuit board assembly 300 includes a circuit board 302 and an electrical connector 304 that is mounted onto a board surface 306 of the circuit board 302. The circuit board assembly 300 is oriented with respect to mutually perpendicular X, Y, and Z axes.

In some embodiments, the circuit board assembly 300 may be a daughter card assembly that is configured to engage a backplane or midplane communication system (not shown). In other embodiments, the circuit board assembly 300 may include a plurality of the electrical connectors 304 mounted to the circuit board 302 along an edge of the circuit board 302 in which each of the electrical connectors 304 is configured to engage a corresponding pluggable input/output (I/O) connector. The electrical connectors 304 and pluggable I/O connectors may be configured to satisfy certain industry standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard. In some embodiments, the pluggable I/O connector may be configured to be compliant with a small form factor (SFF) specification, such as SFF-8644 and SFF-8449 HD. In some embodiments, the electrical connectors 304 described herein may be high-speed electrical connectors.

Although not shown, each of the electrical connectors 304 may be positioned within a receptacle cage. The receptacle cage may be configured to receive one of the pluggable I/O connectors during a mating operation and direct the pluggable I/O connector toward the corresponding electrical connector 304. The circuit board assembly 300 may also include other devices that are communicatively coupled to the electrical connectors 304 through the circuit board 302. The electrical connectors 304 may be positioned proximate to one edge of the circuit board.

The electrical connector 304 includes a connector housing 310 having a plurality of housing sides. The housing sides include a mating side 311 and a mounting side 314. The mating side 311 is configured to engage another connector (not shown), and the mounting side 314 is mounted to the board surface 306. In the illustrated embodiment of FIG. 4, the electrical connector 304 is a right-angle connector such that the mating side 311 and the mounting side 314 are oriented substantially perpendicular or orthogonal to each other. In other embodiments, the mating side 311 and the mounting side 314 may face in different directions than those shown in FIG. 4. For example, the mating side 311 and the mounting side 314 may face in opposite directions.

The connector housing 310 includes a receiving cavity 318 that is sized and shaped to receive a portion of the other connector. For example, in the illustrated embodiment, the receiving cavity 318 is sized and shaped to receive a circuit board (not shown) of the other connector. The circuit board of the other connector may include one or more rows of contact pads (not shown) located along a leading edge of the circuit board.

Figure 5:
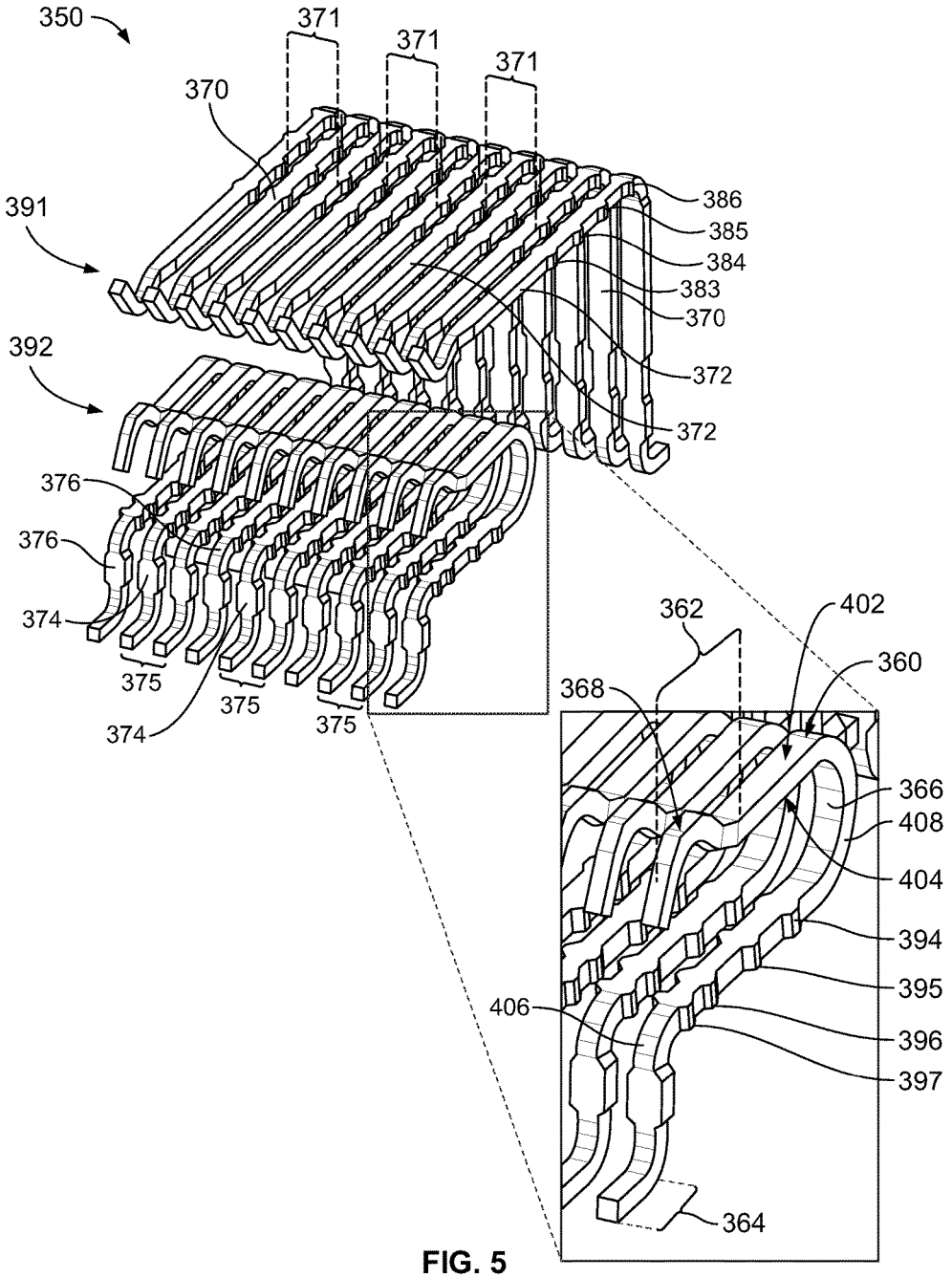
FIG. 5 is a perspective view of a of signal-transmission assembly that may be used with the electrical connector of FIG. 4.

FIG. 5 is a perspective view of a portion of signal-transmission assembly 350 that includes signal and ground conductors 370, 372 and the signal and ground conductors 374, 376 of the electrical connector 304 (FIG. 4). The signal and ground conductors 370, 372 and the signal and ground conductors 374, 376 are configured to extend between the mating side 311 (FIG. 4) and the mounting side 314 (FIG. 4) of the connector housing 310 (FIG. 4). The signal conductors 370 form corresponding signal pairs 371 that are configured to carry differential signals, and the signal conductors 374 form corresponding signal pairs 375 that are configured to carry differential signals. The ground conductors 372 are positioned relative to the signal pairs 371 to electrically separate adjacent signal pairs 371 from each other. Likewise, the ground conductors 376 are positioned relative to the signal pairs 375 to electrically separate adjacent signal pairs 375.

The signal and ground conductors 370, 372 form a first conductor row 391. The signal and ground conductors 370, 372 of the first conductor row 391 may have identical or essentially identical shapes. For example, the signal and ground conductors 370, 372 may be stamped-and-formed from sheet metal using a common press. Likewise, the signal and ground conductors 374, 376 form a second conductor row 392. The signal and ground conductors 374, 376 of the second conductor row 392 may have identical or essentially identical shapes.

Also shown in FIG. 5, the signal and ground conductors 370, 372 may include interference features 383, 384, 385, 386, and the signal and ground conductors 374, 376 may include interference features 394, 395, 396, 397. The interference features 383-386 and 394-397 are configured to engage portions of the connector housing 310 (FIG. 4) to hold the corresponding conductor relative to the connector housing 310.

Although the following is with respect to the first conductor row 391, the description may be also applied to the second conductor row 392. The signal and ground conductors 370, 372 of the first conductor row 391 may be substantially co-planar. Each signal pair 371 is flanked on both sides by ground conductors 372. The ground conductors 372 electrically separate the signal pairs 371 to reduce electromagnetic interference or crosstalk and to provide a reliable ground return path. The signal and ground conductors 370, 372 have a designated pattern. For example, the signal and ground conductors 370, 372 are arranged ground conductor, signal conductor, signal conductor, and ground conductor, which may also be referred to as a GSSG pattern in which the ground conductors 370 are interleaved between the signal pairs 371. In the illustrated embodiment, adjacent signal pairs 371 share a ground conductor 372 such that the pattern forms G-S-S-G-S-S-G-S-S-G. In other embodiments, however, the pattern may be repeated such that an exemplary row of conductors may form G-S-S-G-G-S-S-G-G-S-S-G, wherein two ground conductors 372 are positioned between two adjacent signal pairs 371. In both examples above, the pattern is referred to as a GSSG pattern.

As shown in the enlarged view in FIG. 5, each of the ground conductors 374 is shaped to include a mating terminal (or first terminal) 362, a mounting terminal (or second terminal) 364, and an elongated conductor body 366 that extends therebetween. Each of the ground conductors 374 has an exterior surface 360 that extends along each of the mating terminals 362, the mounting terminals 364, and the elongated conductor bodies 366. The exterior surface 360 includes opposite sides 402, 404 of the ground conductor 372 and edges 406, 408 that extend between and join the opposite sides 402, 404. The ground conductors 372 may have features similar to those shown in the enlarged view for the ground conductors 374.

The mounting terminals 364 are configured to be mechanically and electrically coupled to corresponding conductive elements (not shown). For example, the mounting terminals 364 may be soldered or welded to the corresponding conductive elements. The mating terminals 362 form mating zones 368. Each of the mating zones 368 represents a portion of the exterior surface 360 that intimately engages a corresponding contact of the other connector. For example, the mating zones 368 may slide along corresponding contact pads and remain biased against the corresponding contact pads during operation. The mating zones 368 may have smooth areas of the exterior surface 360 to create a sufficient number of contact points between the ground conductors 374 and the corresponding contact pads.

Figure 6:
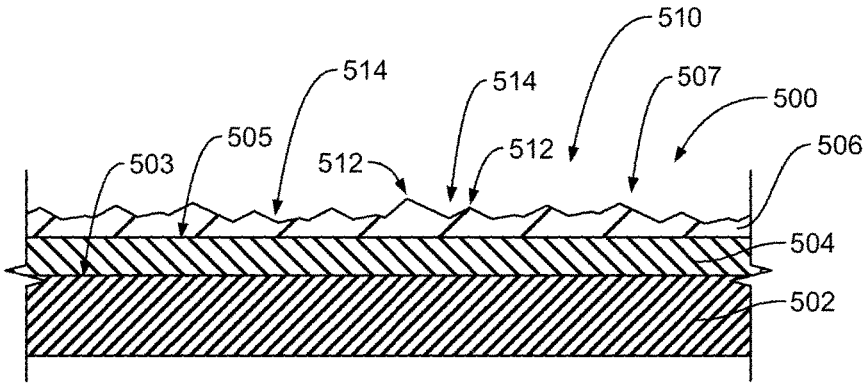
FIG. 6 is an enlarged cross-section of a ground structure in accordance with an embodiment in which a plating layer is manufactured to include a textured area along an exterior of the ground structure.
Figure 7:
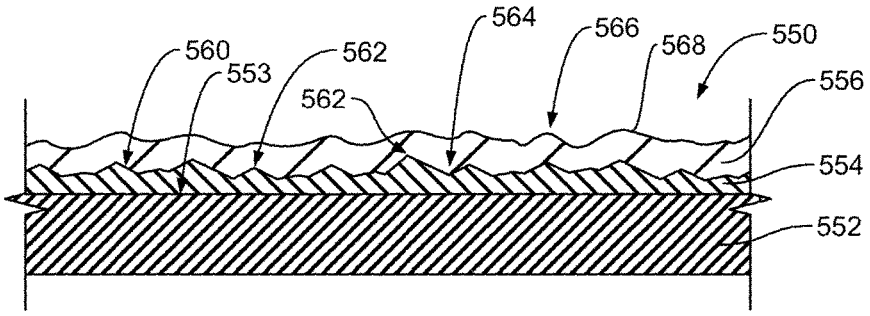
FIG. 7 is an enlarged cross-section of a ground structure in accordance with an embodiment in which an intervening or base layer is manufactured to form a textured area along an exterior of the ground structure.

The exterior surface 360 may also include a textured area (not shown), such as the textured area 507 (shown in FIG. 6) and 566 (shown in FIG. 7). For example, each of the sides 402, 404 may include one or more textured areas. In some embodiments, the textured areas occupy at least 30% of a total area of the exterior surface 360. In some embodiments, the textured areas occupy at least 50% or at least 60% of a total area of the exterior surface 360. In particular embodiments, the textured areas occupy at least 70% or at least 80% of a total area of the exterior surface 360. In particular embodiments, the textured area extends along an entirety of the ground conductor 370, except for the mating zones 368. In particular embodiments, the textured area extends along an entirety of the ground conductor 370, except for the mating zones 368 and the edges 406, 408.

FIG. 6 is an enlarged cross-section of a portion of a ground structure 500 in accordance with an embodiment. The ground structure 500 may be similar or identical to the ground shields and ground conductors described herein. The ground structure 500 includes a base layer (or base material) 502, an intervening or barrier layer 504 that is plated over the base layer 502, and a dampening layer 506 that is plated over the intervening layer 504. The dampening layer 506 includes a textured area 507 of the ground structure 500. The base layer 502 may comprise, for example, a phosphor bronze, beryllium copper, brass, or other metal material. The intervening layer 504 may include, for example, nickel and/or tin and may function as a diffusion barrier between the base layer 502 and subsequent layers. In some embodiments, the dampening layer 506 may be a ferromagnetic material, such as nickel or other materials described above. Alternatively, the dampening layer 506 may be another material (e.g., precious metal material, such as gold). In other embodiments, the additional layer 506 is not used and the intervening layer 504 functions as the dampening layer.

As shown, the base layer 502 and the intervening layer 504 have essentially smooth exterior surfaces 503, 505, respectively. The dampening layer 506, however, has a textured surface 510 that includes numerous peaks 512 and troughs 514. The textured surface 510 may be provided by one or more subtractive or additive processes. Alternatively or in addition to the subtractive or additive processes, the textured surface 510 may be stamped. In such embodiments, the waviness of the textured surface 510 may be more regular or patterned than shown in FIG. 6.

FIG. 7 is an enlarged cross-section of a portion of a ground structure 550 in accordance with an embodiment. The ground structure 550 may be similar or identical to the ground shields and ground conductors described herein. The ground structure 550 may be similar to the ground structure 500 (FIG. 6) and includes a base layer (or base material) 552, an intervening or barrier layer 554 that is plated over the base layer 552, and a dampening layer 556 that is plated over the intervening layer 554. The base layer 552, the intervening layer 554, and the dampening layer 556 may comprise similar or identical materials as those described above with respect to FIG. 6.

The base layer 552 may have an essentially smooth exterior surface 553. The intervening layer 554, however, may have a textured surface 560 that includes numerous peaks 562 and troughs 564. During the manufacturing of the ground conductors, the intervening layer 554 may be processed to include the textured surface 560 before the dampening layer 556 is plated over the intervening layer 554. In such embodiments, the textured surface 560 may cause a textured area 566 of a contact surface 568. The textured area 566 may be less textured than the textured surface 560, but may be sufficiently textured for providing the dampening effect described herein.

Although not shown or described above, ground conductors set forth herein may also include a flash layer and/or a pore-blocking substance. Flash layers typically have relatively small thicknesses. The pore-blocking substance is typically the last material applied and is configured to reduce corrosion along the exterior surface. The pore-blocking substance may have a nominal effect upon the performance of the data transmission. Various methods may be used to apply the pore-blocking substance, such as spraying, brushing, dipping, and the like. Examples of pore-blocking substances that may be used with embodiments described herein include at least one of a polysiloxane (e.g. dimethyl polysiloxane, phenylmethyl polysiloxane), silicate ester, polychlorotrifluoro-ethylene, di-ester, fluorinated ester, glycol, chlorinated hydrocarbon, phosphate ester, polyphenyl ether, perfluoroalkyl polyether, poly-alpha-olefin, petroleum oil, organometallic compound, benzotriazole (BTA), mercaptobenzotriazole, self-assembled monolayer (SAM), or microcrystalline wax.

In some embodiments, the relative magnetic permeability of the designated material that is used for the dampening layer 556 may be measured at a predetermined frequency, such as 1 GHz or 5 GHz. For example, the relative magnetic permeability of the material of the dampening layer 556 at a predetermined frequency may be greater than 50. In some embodiments, the relative magnetic permeability of the material at the predetermined frequency is greater than 100 or, more specifically, greater than 300. In certain embodiments, the relative magnetic permeability of the material at the predetermined frequency is greater than 500 or, more specifically, greater than 600. As one example, the material of the dampening layer 556 may have a relative magnetic permeability of 500 or more at 1 GHz.

Figure 8:
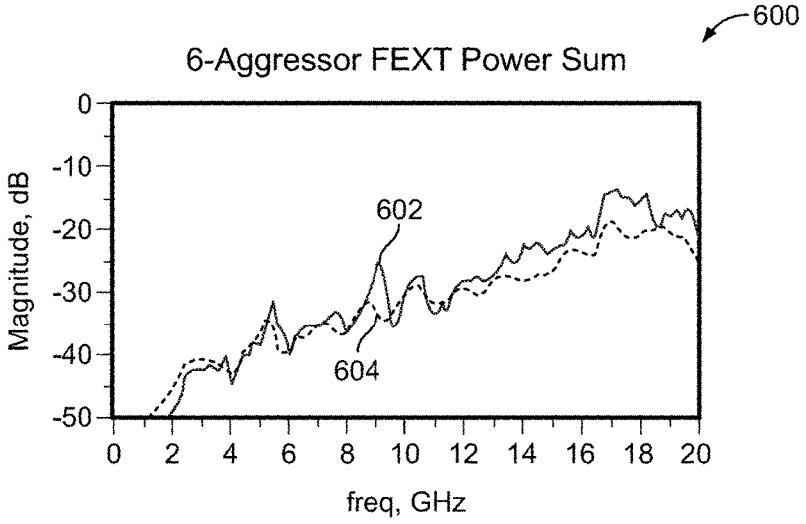
FIG. 8 is a graph that compares far-end crosstalk (FEXT) between a conventional electrical connector and an electrical connector in accordance with an embodiment.

FIG. 8 includes a graph 600 that compares far-end crosstalk (FEXT) between a conventional electrical connector and the electrical connector 100. During this modeling, the electrical connector 100 had a plurality of ground shields 202 (FIG. 2) disposed between adjacent contact modules 104 (FIG. 1). Line 602 represents the performance of the conventional connector, and line 604 represents the performance of the electrical connector 100. As shown, the electrical connector 100 mitigates FEXT across a range of frequencies.

Figure 9:
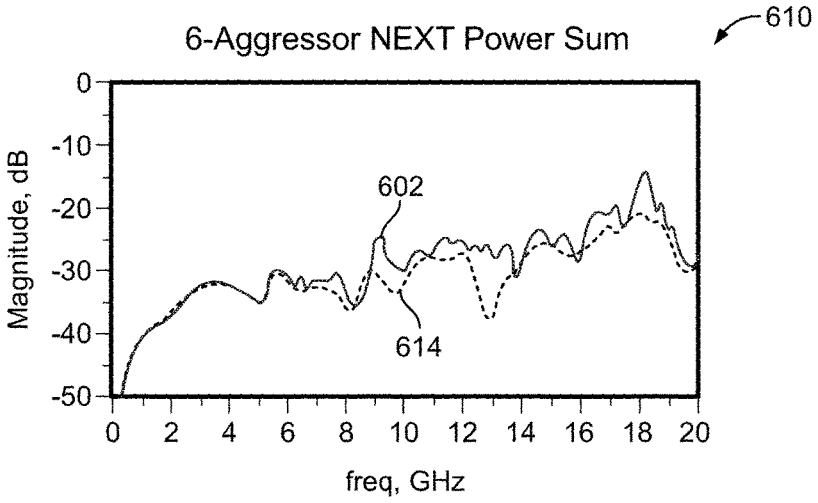
FIG. 9 is a graph that compares near-end crosstalk (NEXT) between a conventional electrical connector and an electrical connector in accordance with an embodiment.

FIG. 9 includes a graph 610 that compares near-end crosstalk (NEXT) between a conventional electrical connector and the electrical connector 100. During this modeling, the electrical connector 100 had a plurality of ground shields 202 (FIG. 2) disposed between adjacent contact modules 104 (FIG. 1). Line 612 represents the performance of the conventional connector, and line 614 represents the performance of the electrical connector 100. As shown, the electrical connector 100 mitigates NEXT across a range of frequencies.

It should be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector housing;

a plurality of signal conductors coupled to the connector housing, each of the signal conductors having a first terminal, a second terminal, and an elongated conductor body extending between the first and second terminals, the first terminals configured to engage corresponding conductive elements of an electrical component; and a ground structure coupled to the connector housing, the ground structure being positioned between adjacent signal conductors and having an exterior surface, at least a portion of the exterior surface having a textured area that is configured to dampen reflected energy that propagates there along.

2. The electrical connector of claim 1, wherein the ground structure includes a ground shield having a panel section that extends between the adjacent signal conductors and a coupling finger that directly engages another component of the electrical connector.

3. The electrical connector of claim 2, wherein the exterior surface includes opposite side surfaces of the ground structure, the ground structure having a stamped edge that extends between the side surfaces, at least one of the side surfaces having the textured area.

4. The electrical connector of claim 3, wherein the textured area is one textured area of a plurality of textured areas, the at least one side surface including the plurality of the textured areas in which the textured areas are separated from one another by one or more smooth areas of the at least one side surface, at least one of the textured areas and at least one of the smooth areas coinciding along a common plane.

5. The electrical connector of claim 2, wherein the exterior surface along the panel section includes at least a portion of the textured area and the exterior surface along the coupling finger either (1) has a smooth area or (2) has a degree of texture that is less than a degree of texture along the panel section.

6. The electrical connector of claim 1, wherein the ground structure includes an elongated ground conductor that extends essentially parallel to the adjacent signal conductors, the ground conductor having the exterior surface, wherein the ground conductor has a mating zone that is configured to engage a corresponding contact of the other connector, the exterior surface along the mating zone having a smooth area.

7. The electrical connector of claim 1, wherein the ground structure includes an elongated ground conductor that extends essentially parallel to the adjacent signal conductors, the ground conductor having the exterior surface, wherein the ground conductor is a plurality of ground conductors, the signal and ground conductors forming a ground-signal-signal-ground (GSSG) pattern.

8. The electrical connector of claim 1, wherein the ground structure has a plating layer, the textured area being topographical deviations of the plating layer, the plating layer comprising a ferromagnetic metal or metal alloy that increases a dampening effect of the textured area.

9. The electrical connector of claim 1, wherein the exterior surface includes a smooth area, the textured area having at least one of (a) an average surface roughness that is at least two-and-a-half times (2.5×) an average surface roughness of the smooth area; (b) a root mean square roughness that is at least two-and-a-half times (2.5×) the root mean square roughness of the smooth area; or (c) a developed surface area ratio with respect to the smooth area that is at least 2.5:1.

10. The electrical connector of claim 1, wherein the ground structure includes a plurality of metal layers, the textured area being formed by topographical deviations of one of the metal layers, wherein the one metal layer is a layer of metal or metal alloy and has a smooth area that borders the textured area, the smooth area and the textured area being portions of a same surface of the ground structure.

11. The electrical connector of claim 1, wherein the ground structure includes a plurality of metal layers, the textured area being formed by irregular topographical deviations of one of the metal layers, wherein the one metal layer is a layer of metal or metal alloy.

12. The electrical connector of claim 11, wherein the one metal layer is an intervening layer and the plurality of metal layers includes a plating layer that is plated over the intervening layer, the plating layer having the textured area, the irregular topographical deviations of the intervening layer causing the textured area of the plating layer.

13. The electrical connector of claim 11, wherein the one metal layer is a precious metal, nickel, tin, copper, iron, copper, cobalt, or an alloy including at least one of the above, the one metal layer being an exterior layer or an underlying layer.

14. The electrical connector of claim 1, wherein the ground structure includes a plurality of metal layers, the textured area being formed by regular topographical deviations of one of the metal layers, wherein the one metal layer is a layer of metal or metal alloy.

15. The electrical connector of claim 14, wherein the one metal layer is an intervening layer and the plurality of metal layers includes a plating layer that is plated over the intervening layer, the plating layer having the textured area, the regular topographical deviations of the intervening layer causing the textured area of the plating layer.

16. The electrical connector of claim 1, wherein the textured area is one of a milled surface, a grinded surface, or an abrasive-blasted surface.

17. An electrical connector comprising:

a connector shroud having a mating side and a loading side, the mating side configured to engage another connector during a mating operation, the connector shroud having passages extending between the mating and loading sides; and a plurality of contact modules having front edges configured to engage the loading side of the connector shroud, each of the contact modules comprising:

a plurality of signal conductors each having a mating terminal, a mounting terminal, and an elongated conductor body extending between the mating and mounting terminals, the mating terminals being positioned along the front edge of the respective contact module, the signal conductors being arranged in signal pairs that are aligned in a conductor plane; and a ground shield having a panel section that extends parallel to the conductor plane and is positioned between the signal conductors of the respective contact module and the signal conductors of an adjacent contact module, at least a portion of the panel section having an exterior surface that includes a textured area configured to dampen reflected energy that propagates there along, the ground conductor having a layer of metal or metal alloy, the textured area being formed by peaks and troughs in the layer of metal or metal alloy.

18. An electrical connector comprising:

a connector housing having a mating side configured to mate with a mating connector and a mounting side configured to be mounted to a circuit board;

signal and ground conductors extending through the connector housing, the signal and ground conductors configured to engage the mating connector and be terminated to the circuit board, the signal conductors forming a plurality of signal pairs configured to carry differential signals, the ground conductors being interleaved between the signal pairs to form a ground-signal-signal-ground (GSSG) pattern, wherein the ground conductors have respective exterior surfaces, at least a portion of each of the exterior surfaces having a respective textured area that is configured to dampen reflected energy that propagates there along.

19. The electrical connector of claim 18, wherein the ground conductors have mating zones that are configured to engage corresponding contacts of the other connector, the exterior surface along each of the mating zones having a smooth area.

20. The electrical connector of claim 18, wherein at least some of the ground conductors comprise a plurality of metal layers including an intervening layer and a plating layer that is plated over the intervening layer, the intervening layer including topographical deviations that cause the textured area in the plating layer.

* * * * *